United States Patent [19]

Watanabe et al.

[11] 3,988,176

[45] Oct. 26, 1976

[54] ALLOY FOR MOLD

[75] Inventors: Seizo Watanabe; Koji Kitazawa; Minoru Maeda; Masaru Yamaguchi, all of Osaka, Japan

[73] Assignee: Hitachi Shipbuilding and Engineering Co., Ltd., Osaka, Japan

[22] Filed: July 26, 1974

[21] Appl. No.: 492,311

[30] Foreign Application Priority Data

Aug. 4, 1973 Japan ..... 48-87820
Aug. 22, 1973 Japan ..... 48-94032

[52] U.S. Cl. ..... 148/32; 75/153; 75/154; 164/273 R; 249/135

[51] Int. Cl.[2] ..... C22C 9/02; C22C 9/06; C22C 9/10; B22D 13/10

[58] Field of Search ..... 75/153, 154; 148/32; 164/273 R; 249/135

[56] References Cited

UNITED STATES PATENTS

| | | | |
|---|---|---|---|
| 2,046,702 | 7/1936 | Scott | 75/154 |
| 2,171,697 | 9/1939 | Hensel et al. | 75/153 |
| 2,202,150 | 5/1940 | Hensel et al. | 75/153 |
| 2,220,464 | 11/1940 | Smith et al. | 75/154 |
| 3,170,204 | 2/1965 | Tarmann | 164/273 R |
| 3,649,254 | 3/1972 | Servi | 75/154 |

*Primary Examiner*—C. Lovell
*Attorney, Agent, or Firm*—Allison C. Collard

[57] ABSTRACT

A mold for continuous casting made of a copper alloy having been subjected to 15 to 40% cold working, said alloy consisting of copper as main constituent and an addition of 0.18 to 0.85% by weight of tin, and, if desired, several other metal components, the alloy having a high softening temperature and high-temperature strength, whose numerical values are given by specific formulas in which the thermal conductivity $\lambda$ is a determining factor which, in itself, is dependent on the construction of the mold, operating conditions etc.

1 Claim, 4 Drawing Figures

ALLOY FOR MOLD

BACKGROUND

The present invention relates to copper alloys and molds made of the copper alloys especially for use in continuous casting apparatuses.

Throughtout the specifications and claims, by the term "mold temperature" is meant the temperature at which the mold is used and the percentages used in connection with the alloy composition are all by weight.

Conventionally, deoxidized copper having a high thermal conductively has been widely used for the molds of continuous casting apparatuses. With the use of a large-sized continuous casting apparatus adapted for a high-speed and efficient operation, the mold has become more prone to a trouble such as deformation or wear when employed relatively few times for casting operation. Such deformation or wear of the mold impedes an improvement in the efficiency of the continuous casting apparatus.

In an attempt to overcome the foregoing problem, we have carried out various experiments and researches with the following finding.

The relationship between the solidification constant K ($mm.min^{-1/2}$) of steel and the thermal conductivity (Kcal/m.hr. ° C) of the mold is expressed by:

$$K = 22.9\lambda^{0.036}$$

The above equation indicates that the thermal conductivity of the mold exerts hardly any influence on the solidification constant of molten steel in the mold. Since the thermal conductivity of pure copper is 290 Kcal/m.hr. ° C, the solidification constant of steel within a mold made of pure copper is about 28. If the thermal conductively reduces to one half the above-mentioned value, the solidification constant is still about 27. Whereas it has generally been believed that the mold must be made of a highly heat-conductive material to promote solidification, the equation shows that the thermal conductivity need not be considered so critical.

The deoxidized copper mold conventionally used has a high thermal conductivity and is therefore subject to the trouble described, since deoxidized copper is not fully satisfactory in high-temperature characteristics. Inasmuch as the thermal conductivity does not exert a noticeable influence on the solidification constant, it is desired to provide a mold which is made of a material having a high softening temperature and great strength at high temperatures although the mold may have a lower thermal conductivity than deoxidized copper molds heretofore used extensively.

Our researches have revealed that the occurrence of trouble in the mold relates to the mold temperature as well as to the thermal stress attributable to that temperature. This invention has been accomplished through researches subsequently conducted on the relationship between the softening temperature of material of the mold and mold temperature and on the relationship between the high-temperature strength of the mold material and the internal thermal stress of the mold.

SUMMARY

A main object of this invention is to provide a copper alloy having outstanding characteristics at high temperatures.

Another object of this invention is to provide a mold for use in continuous casting operation which is serviceable for a prolonged period of time free of deformation or wear.

The present invention provides a copper alloy comprising 0.18 to 0.85% tin and the balance copper. The mold of this invention is made of copper alloy having a thermal conductivity which is 40 to 75% of that of pure copper, softening temperature of at least 370°C and high-temperature strength of at least 32 $kg/mm^2$ when the thermal conductivity is 40% as above, the copper alloy further having a softening temperature of at least 270° C and high-temperature strength of at least 21 $kg/mm^2$ when the thermal conductivity is the above-mentioned 75%.

The present invention will be described below in greater detail with reference to the accompanying drawings.

DESCRIPTION OF SPECIFIC EMBODIMENTS

Figure 1:
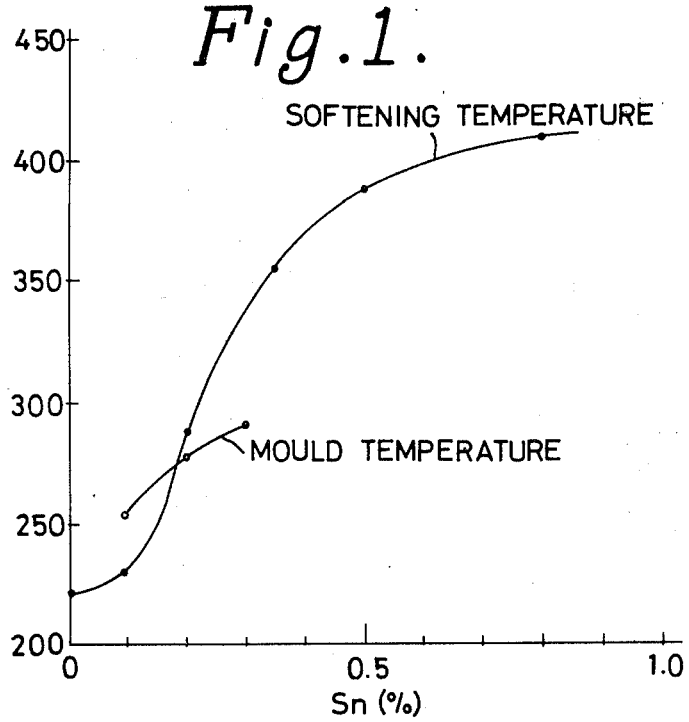
FIG. 1 is a graph showing the relationship of the tin content in a copper alloy with the softening temperature and with the mold temperature.

As already described, the occurrence of trouble in the mold is attributable to the poor high-temperature characteristics of the mold material. Accordingly, we have conducted experiments and researches on the high-temperature characteristics of the mold material required to eliminate troubles and found the relationships expressed by the following formulas (1) and (2):

$$T \geqq 1400C\lambda^{-A} \quad (1)$$

$$S = 274C\lambda^{-B} \quad (2)$$

wherein A = 0.1 to 0.9, B = 0.2 to 1.0, C = 0.5 to 3, T is the softening temperature (°C) required of the mold material, S is the high-temperature strength ($kg/mm^2$) required of the mold material, and λ is the thermal conductivity (%) of the mold when the thermal conductivity of a pure copper mold is assumed to be 100%, each of A, B and C being a constant to be determined in accordance with the construction of the mold, operation conditions, etc.

If λ is determined, T and S will be given by the formulas (1) and (2). As the thermal conductivity of the mold reduces, the mold temperature rises, so that the mold material must have higher softening temperature and high-temperature strength as determined by the formulas (1) and (2). If a mold material has high-temperature characteristics of the numerical values given by these formulas, the mold made of that material will be free of troubles.

In view of the usual strength of copper alloy, the lower limit of thermal conductivity λ must be such that the mold temperature will not exceed 400° C, namely about 115 Kcal/m.hr.°C or 40%. Inasmuch as pure copper which has heretofore been used for molds can not satisfy the formulas (1) and (2), the upper limit of λ is suitably 75%.

For example, if a mold has a thermal conductivity λ of 60%, the mold must have a softening temperature of at least 300°C and high-temperature strength of at least 26 kg/mm² as given by the formulas (1) and (2).

The copper alloy which fulfils the above requirements of thermal conductivity, softening temperature and high-temperature strength is characterized by the composition comprising 0.18 to 0.85% tin and the balance copper.

The addition of tin to copper is effective in elevating the softening temperature and enhancing the strength at high temperatures. FIG. 1 shows the relationship between the tin content of copper alloy and the softening temperature which is critical when the mold is used for a long period of time. The temperature is plotted as ordinate vs. the tin content as abscissa. In this case the heating time is 100 hours and copper and copper alloy are cold-worked to 20%. The figure indicates that whereas the material made of copper alone has a softening temperature of 220° C, the softening temperature increases to 250° C, 375° C and 415° C as the tin content increases to 0.15%. 0.5% and 0.8% respectively. Further increase in the amount of tin above 0.8% is not very effective in raising the softening temperature. Although the addition of tin also elevates the mold temperature as seen in FIG. 1, the softening temperature must always be higher than the mold temperature. Accordingly, the lower limit of the tin content is determined at 0.18% by the softening temperature.

Figure 2:
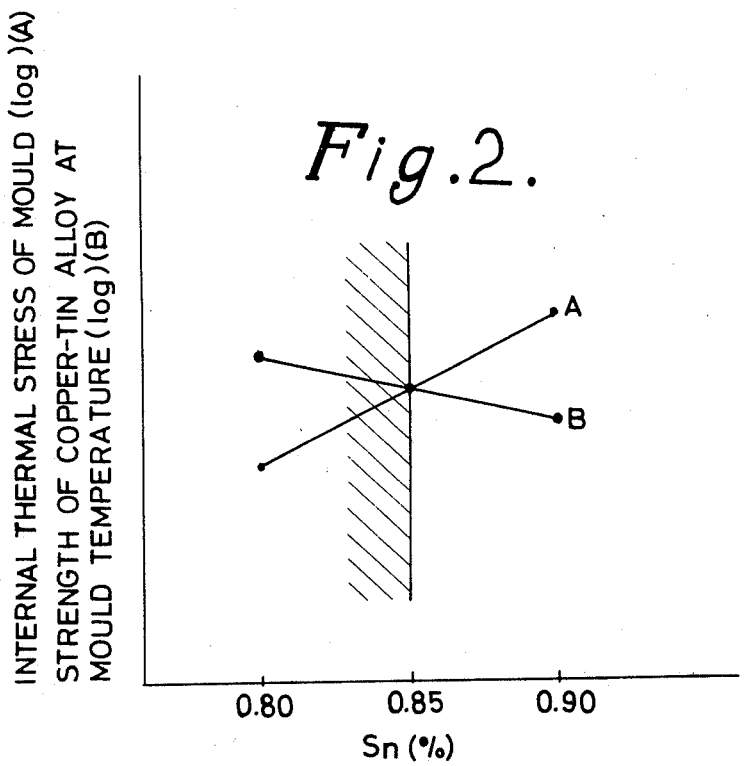
FIG. 2 is a graph showing the relationship of the tin content with the internal thermal stress of the mold and with the high-temperature strength of the copper-tin alloy.

With the increase in the amount of tin added to copper, the mold temperature also rises as described above, but the softening temperature rises at a much greater rate than the mold temperature. Consequently, the increase in the amount of tin will not be limited by the softening temperature but is restricted in view of the high-temperature strength. As will be described later, the addition of tin to copper gives greater high-temperature strength than when it is not used. However, an increase in the amount of tin in excess of a certain limit does not materially improve the high-temperature strength but lowers the thermal conductivity and elevates the mold temperature, thereby enhancing the thermal stress in the mold. Accordingly, the upper limit of the tin content is so determined that the high-temperature strength of mold material will be in the range greater than the predetermined internal thermal stress of the mold. FIG. 2 shows the relationship between the reduction in relative high-temperature strength resulting from the decrease in thermal conductivity when the amount of tin increases in the vicinity of its upper limit and the thermal stress in the mold produced by the increasing mold temperature. The strength and thermal stress are plotted as ordinate and the amount of tin, as abscissa. It is the strength of material of the mold at the mold temperature that is critical when the mold is put to use. The use of materials different in thermal conductivity when making the mold invariably produces a difference in mold temperature, so that when materials of different thermal conductivities are compared in respect of high-temperature strength, the difference in mold temperature must be taken into consideration. More specifically, if the amount of tin in copper-tin alloy is in the range of 0.80 to 0.90%, there is hardly any variation in the strength of alloy at the same temperature, but the thermal conductivity drops with the increase in the amount of tin, consequently elevating the mold temperature. Thus what matters is the strength of material at the higher temperature corresponding to the increase in mold temperature due to the increase in the amount of tin. The larger the tin content, the lower is the relative high-temperature strength that is critical. It will be apparent from FIG. 2 that if the amount of tin is smaller than 0.85%, the high-temperature strength exceeds the thermal stress of the mold and the mold will not undergo plastic deformation, whereas if the amount is greater than 0.85%, the thermal stress is higher than the high-temperature strength. Thus the upper limit of the amount of tin is 0.85%.

The addition of at least one of chromium, silicon and magnesium to copper alloy containing 0.18 to 0.85% of tin is effective in elevating the softening temperature. The softening temperature of copper-0.5% tin alloy which is 390° C rises to 450°C if it further contains 0.3% chromium, to 420° C and to 430° C if the alloy contains 0.2% and 0.5% silicon respectively, and to 420° C and 440° C when the alloy contains 0.2% and 0.5% magnesium respectively.

The addition of at least one of chromium, silicon and magnesium also results in a small increase in strength at high temperatures and a greater increase in mold temperature, consequently entailing a small increase in the relative strength of the mold at the mold temperature. On the other hand, the thermal stress produced in the mold increases with the increase in the mold temperature. It therefore follows that the amount of the third element to be added to copper-0.18 to 0.85% tin alloy need be limited to such range that the relative strength of the mold will not be lower than the internal thermal stress of the mold. The addition of at least one of chromium, silicon and magnesium to the above-mentioned copper alloy produces an increase of about 2 kg/mm² in the relative high-temperature strength at the mold temperature, this permitting an increase in the internal thermal stress of the mold which corresponds to 2 kg/mm², namely to the increment of the relative high-temperature strength, as compared with the case wherein none of chromium, silicon and magnesium are added. The permissible increment of 2 kg/mm² in the internal thermal stress of the mold can be interpreted in terms of an increase in the mold temperature, which in turn may be considered in terms of a reduction in the thermal conductivity of the mold. Thus the alloy containing the third element is allowed to have about 16 Kcal/m.hr.°C lower thermal conductivity than copper-tin alloy. This indicates that the upper limit of amount of at least one of chromium, silicon and magnesium to be added to copper-tin alloy which limit is determined by the thermal conductivity is such that the thermal conductivity will reduce by 16 Kcal/m.hr.° C. When one of chromium, silicon and magnesium is to be added to alloy of copper and 0.18 to 0.85% tin, the upper limit of amount of the third element contained in the alloy is 0.2% in the case of copper-0.85% tin alloy which is the lowest in thermal conductivity, and 0.7% for copper-0.18% tin alloy which is the highest in thermal conductivity. When two or all of chromium, silicon and magnesium are added conjointly, the upper limit of the combined amount of these elements is also 0.7%. If the amount of at least one of chromium, silicon and magnesium is below 0.1%, the third element will not greatly elevate the softening temperature.

Accordingly, the copper alloy comprising 0.18 to 0.85% tin and the balance copper may contain at least one element selected from the group consisting of chromium, silicon and magnesium, preferably in the total amount of 0.1 to 0.7%.

Furthermore, it is preferable that a copper alloy containing 0.18 to 0.4% tin further contains 0 to 0.22% magnesium, 0.3 to 0.7% silicon, 0.45 to 2.5% nickel, 0.02 to 0.15% silver and 0.02 to 0.15% lithium. The addition of 0 to 0.22% magnesium and 0.3 to 0.7% silicon serves to give the mold a higher softening temperature and greater strength at high temperatures. The addition of 0.45 to 2.5% nickel produces similar effects. The addition of 0.02 to 0.15% of silver is effective in elevating the softening temperature. Use of 0.02 to 0.15% lithium effectively serves to give finer crystalline structure.

Preferably, the copper alloy of this invention is subjected to 15 to 40% cold working and made into molds. If the working degree is lower than 15%, the alloy will not have the desired strength as a material for molds, whilst if it is higher than 40%, the softening temperature will be below the desired level.

EXAMPLE 1

The copper alloy of this example comprises 0.6% tin and the balance copper. The copper alloy was subjected to 20% cold working and made into a mold, which was set in a continuous casting apparatus and tested. Whereas the conventional mold of deoxidized copper underwent deformation when used about 50 times for casting, the mold of this example was usable about 150 times for continuous casting.

The mold of this invention will be described below in comparison with those made of a hot-forging of deoxidized copper conventionally used widely and of 20% cold-worked material of the same.

The mold temperature of the deoxidized copper mold was actually measured and the thermal stress thereof due to that temperature was calculated. The mold temperature was found to be about 240° C and the thermal stress, about 19 kg/mm$^2$.

Figure 3:
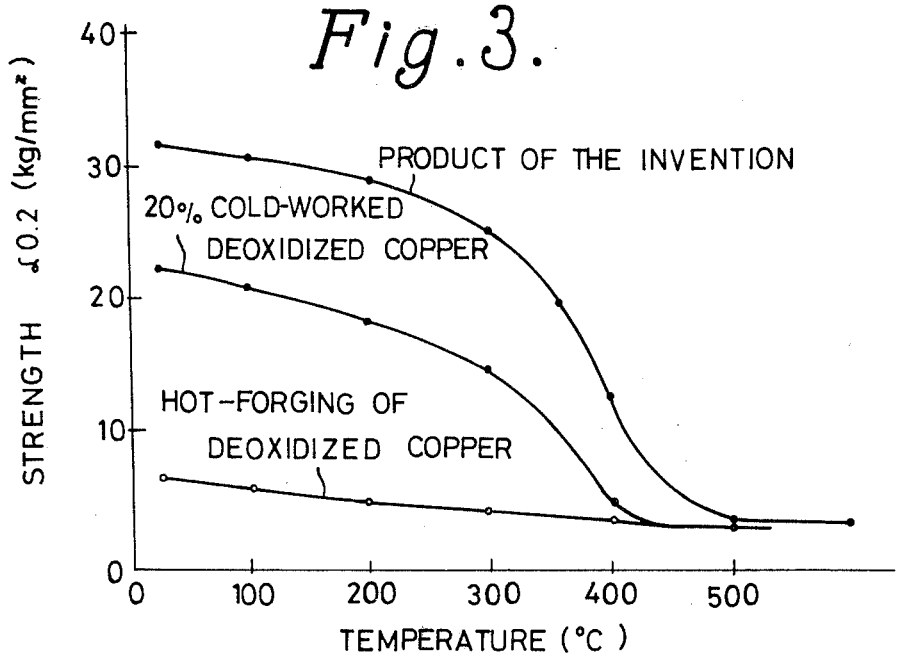
FIG. 3 is a graph showing the high-temperature strength of hot-forging of deoxidized copper, 20% cold-worked material of the same and the product of this invention.

In FIG. 3 showing the relationship between the elevation of temperature and strength, strength is plotted as ordinated vs. temperature as abscissa. The hot-forging is as low as about 5 kg/mm$^2$ in strength at the mold temperature and is therefore very susceptible to plastic deformation due to the internal thermal stress of the mold. This results in troubles in the mold. Cold working imparts to deoxidized copper much higher strength than hot forging. However, even if cold-worked to 20%, deoxidized copper has the strength of about 19 kg/mm$^2$ at the mold temperature which is lower than the thermal stress. The product of this invention has the strength of about 35 kg/mm$^2$ at room temperature which is about five times that of the hot-forging of deoxidized copper. At the mold temperature, it has the strength of about 27 kg/mm$^2$ which is higher than the thermal stress.

Figure 4:
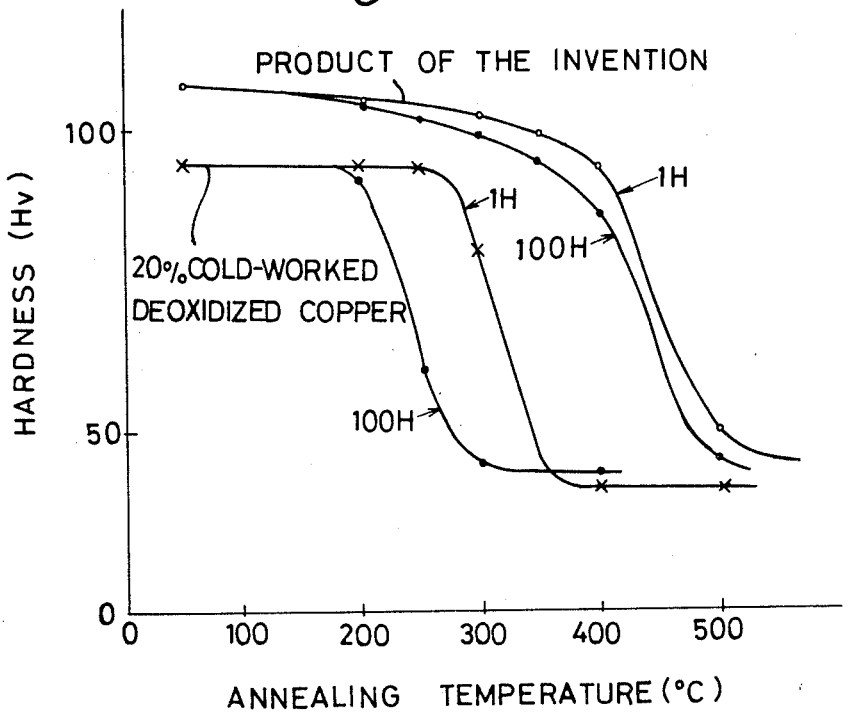
FIG. 4 is a graph showing the relationship between the annealing temperature of 20% cold-worked material of deoxidized copper and the product of this invention and their hardness.

FIG. 4 shows the relationship between the elevation of annealing temperature and hardness. Hardness is plotted as ordinate and annealing temperature, as abscissa. Deoxidized copper material prepared by 20% cold working softens at temperatures in excess of about 270° C and about 200° C if the heating time is 1 hour and 100 hours respectively, whereas when the product of this invention is heated for 1 hour and 100 hours, the difference in softening temperature between the two cases is small. Even when heated for 100 hours, it does not soften at temperatures of below about 390° C, which is about 170° C higher than the softening temperature of the 20% cold-worked deoxidized copper and is of course higher than the mold temperature.

As will be apparent from the foregoing description that the product of this invention has high-temperature strength which is greater than the internal thermal stress of the mold and a softening temperature which is higher than the mold temperature. Thus it is satisfactorily serviceable for a prolonged period of time.

EXAMPLE 2

The copper alloy of this example comprises 0.3% tin and the balance copper. The copper alloy was subjected to 20% cold working and made into a mold, which was tested in the same manner as in Example 1. The mold was found usuable about 100 times for continuous casting.

EXAMPLE 3

The copper alloy of this example comprises 0.75% tin and the balance copper. The copper alloy was subjected to 20% cold working and made into a mold, which was tested in the same manner as in Example 1. The mold was found usuable about 170 times for continuous casting.

EXAMPLE 4

The copper alloy of this example comprises 0.5% tin, 0.5% chromium and the balance copper. The copper alloy was subjected to 20% cold working and made into a mold, which was tested in the same manner as in Example 1. The mold was found usuable about 250 times for continuous casting.

EXAMPLE 5

The copper alloy of this example comprises 0.4% tin, 0.2% silicon and the balance copper. The copper alloy was subjected to 20% cold working and made into a mold, which was tested in the same manner as in Example 1. The mold was found usuable about 200 times for continuous casting.

EXAMPLE 6

The copper alloy of this example comprises 0.4% tin, 0.2% magnesium and the balance copper. The copper alloy was subject to 20% cold working and made into a mold, which was tested in the same manner as in Example 1. The mold was found usuable about 200 times for continuous casting.

EXAMPLE 7

The copper alloy of this example comprises 0.4% tin, 0.2% chromium, 0.2% silicon, 0.15% magnesium and the balance copper. The copper alloy was subjected to 20% cold working and made into a mold, which was tested in the same manner as in Example 1. The mold was found usuable about 300 times for continuous casting.

EXAMPLE 8

The copper alloy of this example comprises 0.4% tin, 1.9% nickel, 0.4% silicon, 0.1% silver, 0.05% lithium and the balance copper. The copper alloy was subjected to 20% cold working and made into a mold, which was tested in the same manner as in Example 1. The mold was found usuable about 400 times for continuous casting.

EXAMPLE 9

The copper alloy of this example comprises 0.2% tin, 1.6% nickel, 0.6% silicon, 0.1% silver, 0.03% lithium and the balance copper. The copper alloy was subjected to 20% cold working and made into a mold, which was tested in the same manner as in Example 1. The mold was found usuable about 300 times for continuous casting.

The copper alloy of this invention may of course contain some amounts of impurities insofar as they are not detrimental in fulfilling the objects of this invention.

The present invention can be practiced in other different modes without departing from the spirit and basic features of the invention. Thus the examples therein disclosed are given for illustrative purposes only and is not limitative in any way. The scope of this invention is defined by the appended claims rather than by the above specification. All the modifications and alternations within the scope of the claims are to be construed as being covered by the claims.

What we claim is:

1. A mold for continuous casting made of a copper alloy having been subjected to 15 – 40% of cold working, the thermal conductivity of the alloy being 40 to 75% of that of pure copper, the alloy consisting of copper as main constituent, 0.18 to 0.4% by weight of tin, 0 to 0.22% of magnesium, 0.3 to 0.7% of silicon, 0.45 to 2.5% of nickel, 0.02 to 0.15% of silver and 0.02 to 0.15% of lithium, and having a softening temperature and high-temperature strength of the numerical values given by the formulas (1) and (2)

$$T \geqq 1400C\,\lambda^{-A} \quad (1)$$

$$S \geqq 274C\,\lambda^{-B} \quad (2)$$

wherein A = 0.1 to 0.9, B = 0.2 to 1.0, C = 0.5 to 3, T is the softening temperature (°C) required of the mold material, S is the high-temperature strength (kg/mm$^2$) required of the mold material, and λ is the thermal conductivity (%) of the mold when the thermal conductivity of a pure copper mold is assumed to be 100%, each of A, B and C being constant to be determined in accordance with the construction of the mold, operation conditions, and the like.

* * * * *